United States Patent [19]

Hsieh

[11] Patent Number: 4,918,818

[45] Date of Patent: Apr. 24, 1990

[54] MULTI-PURPOSE MASSAGE SHAVER

[76] Inventor: Yin-Fei Hsieh, No. 10, Sublane 12, Lane 629, Neihu Road, Sec. 1, Taipei, Taiwan

[21] Appl. No.: 247,287

[22] Filed: Sep. 22, 1988

[51] Int. Cl.[5] ..... B26B 19/38

[52] U.S. Cl. ..... 30/34.05; 30/123

[58] Field of Search ..... 30/34 R, 90, 41, 123; 15/110

[56] References Cited

U.S. PATENT DOCUMENTS 3,104,662 9/1963 Morawetz° ..... 30/34 R 3,793,724 2/1974 Messinger et al. ..... 30/90 X 4,631,825 12/1986 Kuriyama et al. ..... 30/41 X

*Primary Examiner*—Frank T. Yost

*Assistant Examiner*—Willmon Fridie, Jr.

*Attorney, Agent, or Firm*—Lowe, Price, LeBlanc, Becker & Shur

[57] ABSTRACT

A multi-purpose massage shaver, with a connecting seat which has a guide slot, and an elastic flange at the center of the connecting seat to hold and latch razor holder, face massager, gums massager, or eye socket bone massager etc. for differing functions.

4 Claims, 4 Drawing Sheets

MULTI-PURPOSE MASSAGE SHAVER

BACKGROUND OF THE INVENTION

This invention relates to a shaving-massaging instrument designed to shave off beard and massage the body surface from where beard is shaved off. The commonly used shavers are exclusively designed for shaving off beard. We now want to improve and add other devices to the shaver to vary its function. The economic effect of this instrument can now be fully realized when shaving is not necessary and it is used to massage body surfaces especially the gums of the teeth and socket bones of the eye. Also, this instrument will be provided at cheaper prises, the present massagers are either very expensive or out of stock.

SUMMARY OF THE INVENTION

The purpose of this invention is to provide a multipurpose massage shaver, whose body is integrated into one unit. The inner portion is arranged in a hollow handle with a mini-motor and an eccentric block placed therein to control the vibration. It uses an outer control switch which shifts a magnetic plate to turn on an inner reed. The inner reed drives the motor to rotate and to further let the razor holder at the upper guide slot provide massaging effect. It has a bettery cover which is water-proof. Also it has a rubber washer and a reed. The rubber washer and the reed is separated from the control switch. There is connecting seat at the body of the invention with an elastic flange at the center to hold and latch a variety of accessories including razor blades, gum and eye massaging elements. When replacement is necessary, the elements can be easily pull out from the massage-shaver instrument making room for a new element or razor blade.

DESCRIPTION OF THE PREFERRED EMBODIMENTS

Figure 1:
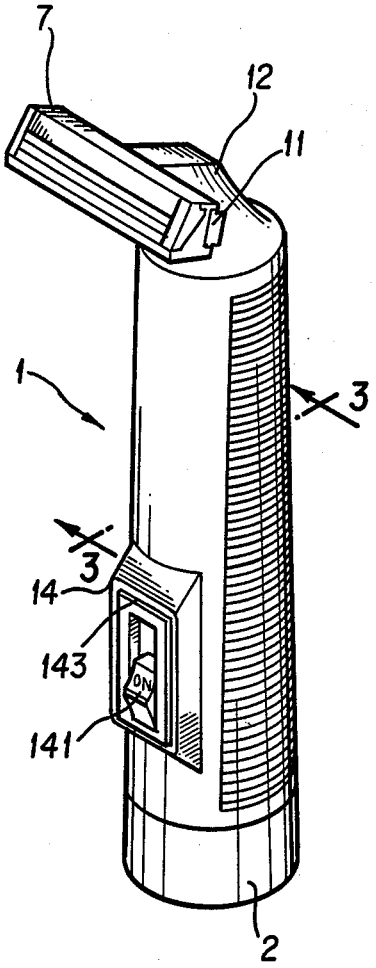
FIG. 1 illustrates the massage shaver.
Figure 2:
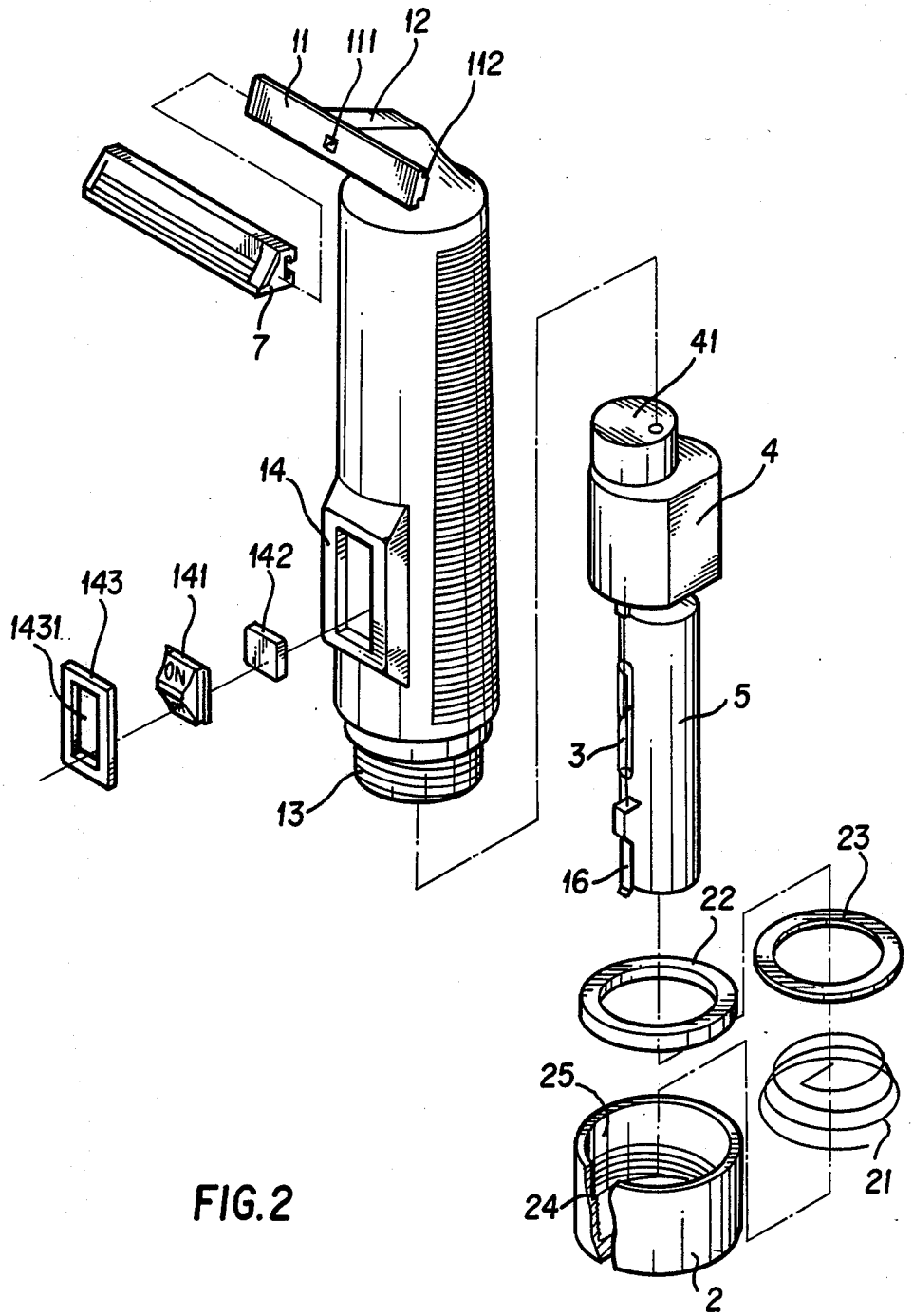
FIG. 2 is a dismantled view of the preferred embodiment of this invention.
Figure 3:
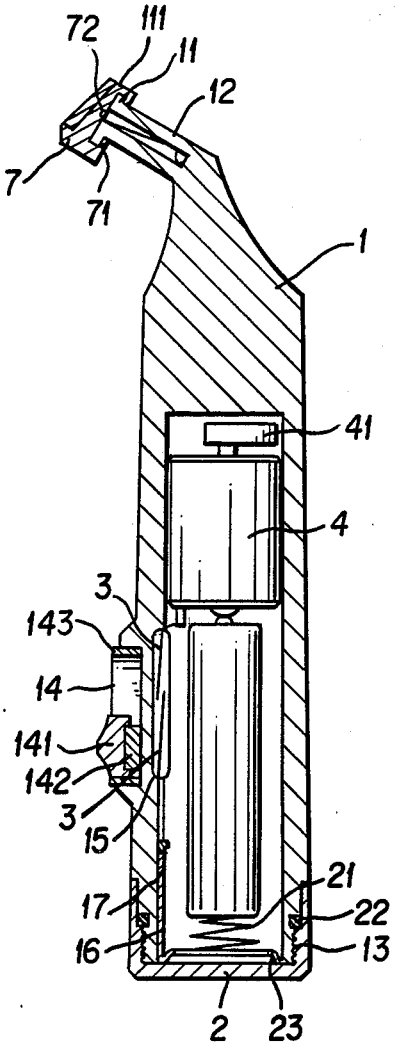
FIG. 3 is a cross-sectional view of the preferred embodiment of this invention.

In the preferred embodiment as shown in FIGS. 1 and 2, the body (1) of this invention is arranged to provide a hollow and conical configuration for attaching the motor (4), the eccentric block (41), and for holding battery (5) therein. A trailing (13) is arranged at its bottom for fixing of battery cover (2) by means of screw joint. The battery cover (2) has a conductive spring (21), a rubber washer (22), and a conductive ring plate (23). The rubber washer (22) is arranged at the top of a trapezoidal groove (24) inside the battery cover such that the rubber washer (22) is tightly in contact with the body (1) when the battery cover (2) is screwed up with the body. This arrangement provides water proofing effect. Again the body (1) of this invention is made to provide a scoop channel (15) inside the inner hollow chamber for a reed (3). One end of the reed (3) is connected with the input terminal of the motor (4), and the other end connected with a metal leaf (16) which is attached to the scoop channel (17) of the body (1). The trough (25) of the battery cover (2) is for allocation of spring (21). The lower part of the spring (21) is connected to a conductive ring plate (23). The top or upper part of the spring (21) is connected to the negative end of the battery (5), such that the conductive ring plate (23) contacts the metal leaf (16) of the body (1) to "turn on" the power at the time the battery cover (2) is screwed up with the body. The rubber washer (22) provides a water proofing effect.

The body of this invention also has a control switch (14) which is composed of a shifting button (141), a magnetic plate (142) and a frame (143), and being arranged at the outer surface around the reed (3). The shifting button latches on a magnetic plate (142) which in turn is adhered to a confinement frame (148). The shifting button (141) is movably arranged within the square hole (1431) of the frame (143). As the shifting button (141) is attached to the magnetic plate (142) to control the opening or closing of the reed (3), therefore, the motor (4) drives the eccentric block (41) to revolve and vibrate when the button is shifted to "ON" position.

The upper part of the body (1) of this invention is arranged in a conical configuration to provide a bearing portion (12). Said bearing portion (12) is curved to provide a connecting seat (11) at the top for fixation of different accessories, like razor holder (7), face massager (8), gums massager (9), massager of eye socket bones (6), etc.

The connecting seat (11) is arranged in a U-shaped configuration with an elastic flange (111) at the center. When the retaining slot (71) of the razor holder (7) or face massager is guided into the U-shaped track (112), the flange (111) is set in the central recess (72) of the razor holder or face massager, etc, firmly pinched and locked. To separate the razor holder (7) from the connecting seat (11) of the body (1), simply push the razor holder out.

Figure 4:
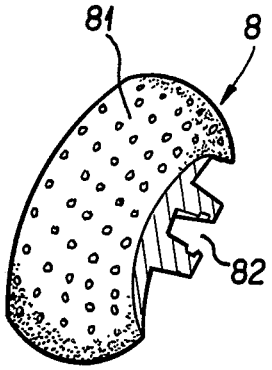
FIG. 4 is a sectional view of the face massaging element.

In FIG. 4, the face massager (8) according to this invention comprises a retaining slot (82) for insertion into the U-shaped track (112), of which a round, outer surface has a plurality of small flanges (81) to strengthen the scratching force at the time the face massager (8) is used to massage human face.

Figure 5:
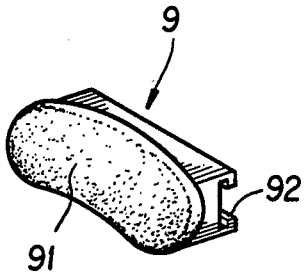
FIG. 5 is a perspective view of the gums massaging element.

In FIG. 5, the gums massager (9) according to the invention is used to massage the gums of the teeth by means of vibrating force to prevent periodontosis, its contact surface (91) is made of solid material and arranged in a curved shape to fit the gums of the teeth. It has a retaining slot (92) for fixation with the connecting seat (11) of the body (1). When the motor (4) starts, it provides vibration force, for massaging of gums.

Figure 6:
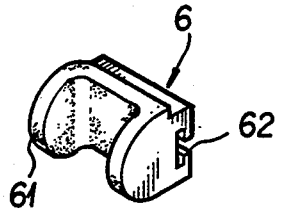
FIG. 6 is a perspective view of the eye bones massaging element.

In FIG. 6, the eye socket and bone massager (6) is a concave configuration (61) for a perfect contact with the eye socket bones above the nose. It has a U-shaped retaining slot (62) for fixation with the connecting seat (11) of the body (1) such that the eye socket bone massager (6) can be used to massage efficiently when the botton is switched on.

I claim:

1. A multiple purpose masager and shaver device comprising:

an elongated housing having a generally cylindrical base and central portion and a generally conical upper portion, the base having an open lower end and said base and central portion being hollow;

end sealing means including a cap threadedly mounted on the open end of said base for releasably sealing said open end so that the hollow interior of said housing is waterproof when said cap is mounted on said base;

an electric motor mounted in the hollow central portion of said housing;

vibrator means including a block and an eccentric drive therefor coupled to said motor; battery means mounted in the hollow base of said housing; external switch means mounted on said housing and coupled between said battery means and said motor for selectively energizing said motor to drive said block in eccentric rotation to thereby cause said housing to vibrate;

mounting means including a laterally extending U-shaped track mounted on the upper end of said housing at substantially the apex of the conical end for receiving a shaver head or a massage head; and lock means carried by said track for releasably securing a head on said track.

2. The device of claim 1 further comprising an elongated shaver head having at least one razor blade extending the length of one side and defining a channel extending the length of the opposite side the channel dimensional to slidably receive said U-shaped track whereby said shaver head is mounted on said housing.

3. The device of claim 1 further comprising a massage head having a massage surface on a front side and the opposite side defining a channel, the channel dimensional to slidably receive the U-shaped track whereby said message head is mounted on said housing.

4. The device of claim 1 wherein said lock means includes an elastic flange disposed on the outer surface of said U-shaped track for frictionally engaging a shaver head or a massage head when mounted thereon.

* * * * *